United States Patent [19]

Grove

[11] 3,979,167

[45] Sept. 7, 1976

[54] INTERNAL GEAR SET HAVING ROLLER TEETH

[76] Inventor: Leslie H. Grove, 707 E. Hoyt Ave., St. Paul, Minn. 55106

[22] Filed: Jan. 27, 1975

[21] Appl. No.: 544,644

[52] U.S. Cl. ..... 418/61 B; 418/171; 74/805

[51] Int. Cl.[2] ..... F01C 1/02; F01C 1/10; F03C 3/00; F16H 1/28

[58] Field of Search ..... 418/58, 61 B, 166, 171, 418/225; 74/804, 805

[56] References Cited

UNITED STATES PATENTS

| | | | |
|---|---|---|---|
| 1,389,189 | 8/1921 | Feuerheerd | 418/166 |
| 1,968,113 | 7/1934 | Weaver | 418/171 |
| 3,289,602 | 12/1966 | Hudgens | 418/61 B |
| 3,424,095 | 1/1969 | Hansen | 418/61 B |
| 3,623,829 | 11/1971 | Shaw | 418/171 |
| 3,723,032 | 3/1973 | Woodling | 418/61 B |
| R24,288 | 3/1957 | Nanni | 74/805 |

FOREIGN PATENTS OR APPLICATIONS

| | | | |
|---|---|---|---|
| 228,548 | 7/1925 | United Kingdom | 74/804 |

*Primary Examiner*—John J. Vrablik
*Attorney, Agent, or Firm*—David A. Roden; Robert E. Granrud

[57] ABSTRACT

Internal gear set comparable to a geroter gear set except that all teeth are provided by rollers positioned in slightly oversize pockets. The internal gear set may have two, three or more gear members to provide, respectively, one, two or more sets of expanding and collapsing chambers and may be used as a hydraulic motor, pump and/or speed reducer.

16 Claims, 7 Drawing Figures

INTERNAL GEAR SET HAVING ROLLER TEETH

CROSS-REFERENCE TO RELATED APPLICATIONS

The internal gear set of the present invention is an improvement over the cam-roller rotary mechanism of my copending application Ser. No. 368,871, filed June 11, 1973, (now U.S. Pat. No. 3,910,733) as a continuation-in-part of my application Ser. No. 143,869, filed May 17, 1971 (now abandoned), which in turn was a continuation-in-part of my application Ser. No. 859,117, filed Sept. 18, 1969 (now abandoned). Because hydraulic devices incorporating the novel gear set can be valved in the same way as in said application Ser. No. 368,871, the disclosure in that application concerning valving is incorporated by reference into the present application.

BACKGROUND TO THE INVENTION

Geroter gear sets commonly used in hydraulic motors and pumps are expensive to design and difficult to manufacture to the necessary close tolerances. Special cutters must be provided for machining the teeth. The sliding of one gear against the other causes wear, eventually destroying the fluid-tight contact between the mating gear faces and requiring one or both of the gears to be replaced at considerable expense.

Others have modified 2-member internal gear sets by replacing the teeth of the outer gear member with rollers which may be positioned in oversize recesses as in U.S. Pat. No. 3,591,320 (Woodling). That patent does not suggest any change in the inner gear member which, as illustrated, has a geroter tooth form. U.S. Pat. Nos. 3,289,602 (Hudgens) and No. 3,627,454 (Goff) similarly show hydraulic devices wherein a conventional inner geroter gear member cooperates with an outer gear member comprising rollers retained in recesses.

While no prior art has been found showing a 3-member geroter or other internal ger set employing rollers, the teachings of the aforementioned patents should be applicable to such 3-member gear sets, namely, that the inner-facing teeth may be replaced by rollers.

OTHER PRIOR ART

Turning to a somewhat different art, U.S. Pat. No. 3,288,121, (Linder) shows a rotary piston engine having a piston of oval cross-section in continuous treble contact with three rollers. The patent suggests that the same design can be used as a compressor or a pump.

THE PRESENT INVENTION

In the internal gear sets of the present invention, all of the teeth are provided by cylindrical rollers positioned in slightly oversize pockets. In its simplest form, the invention may be embodied in a 2-member gear set, the first or inner gear member having $n$ equal or identical rollers in semi-cylindrical pockets, $n$ being an integer greater than 2, preferably at least 5. The pockets are formed in the radially outer face of the first gear member with the centers of the rollers and pockets equally spaced along a circle, the center of which is the axis of the first gear member. The second gear member has $n + 1$ identical rollers in semi-cylindrical pockets formed in its radially inner face with the centers of the rollers and pockets equally spaced on a circle, the center of which is the axis of the second gear member. The first gear member nests within and is axially offset from the second gear member to provide expanding and collapsing chambers between the gear members upon rotation of one gear member relative to the other as in a geroter gear set.

Each roller separating expanding and collapsing chambers is forced by the higher pressure against the side of its pocket toward the low-pressure chamber. Inasmuch as the pockets are oversize, the higher fluid pressure extends across the base of each pocket to force the rollers into contact with each other. The three points of contact help to create an essentially fluid-tight seal between the expanding and collapsing chambers.

In order to permit the fist gear member to nest within the second, the distance between each roller of the second gear member and the face of the body of the second gear member opposite that roller must exceed the maximum breadth of the first gear member when the rollers are fully seated in their pockets. Adjacent rollers of each gear member should be spaced sufficiently to afford adequate structural integrity. Wider spacing tends to enhance volumetric displacement, especially if each roller contacts or nearly contacts the face of the body of the other gear member when centered between two rollers of that gear member, thus providing almost complete collapse of the chambers. In any event, the diameter of each roller must exceed the spacing between adjacent rollers of the other gear member, preferably by at least 10 percent to provide smooth mechanical driving action.

To achieve maximum volumetric displacement, the faces of the body of each gear member between adjacent rollers may be shaped to match the opposing rollers.

To minimize wear, the pockets form complete semi-cylinders and preferably extend arcuately somewhat beyond semi-cylinders to hold the rollers in place during assembly.

A 3-member gear set of the present invention employs the same first and second gear members as in the 2-member gear set except that the second or intermediate gear member has $m$ identical rollers in slightly oversize semi-cylindrical pockets formed in its outer face and the third or outer gear member has $m + 1$ identical rollers in slightly oversize semi-cylindrical pockets formed in its inner face, $m$ being an integer greater than 2, equal to or different from $n$, and preferably at least 6. The outer-facing pockets of the intermediate gear member are equally spaced along a circle having the axis of the intermediate gear member as its center. The pockets of the outer gear member are equally spaced along a circle having the axis of the outer gear member as its center. For simplicity in manufacture, $m$ equals $n + 1$. For economy of material, each outer-facing pocket of the intermediate gear member is midway between its adjacent inner-facing pockets.

Each of the three gear members is rotatable on a unique fixed axis, the three axes lying on a straight line such that the distance between the axes of the intermediate and outer gear members is an integral multiple of the distance between the axes of the inner and intermediate gear members. When that integral multiple is one, the volumetric displacement at the inner set of chambers is comparable to that at the outer set. Because very close tolerances are required for such a gear set, an integral multiple of at least two is generally preferred.

The internal gear set of the present invention is more reliably and easily designed if the aforementioned integral multiple does not exceed four.

A fluid pressure device employing a 3-member gear set of the present invention may be valved in the manner disclosed in my aforementioned application Ser. No. 368,871 for the rotary mechanism of FIG. 4 thereof.

If desired, the 3-member gear set may be nested within a fourth or more similarly constructed gear members, for example, to effect further volumetric displacement or to increase fluid torque, or to mix or separately pump more than two fluids at one time.

THE DRAWING

In the drawing:

FIG. 1 schematically illustrates a 2-member internal gear set embodying the invention;

Figure 1:
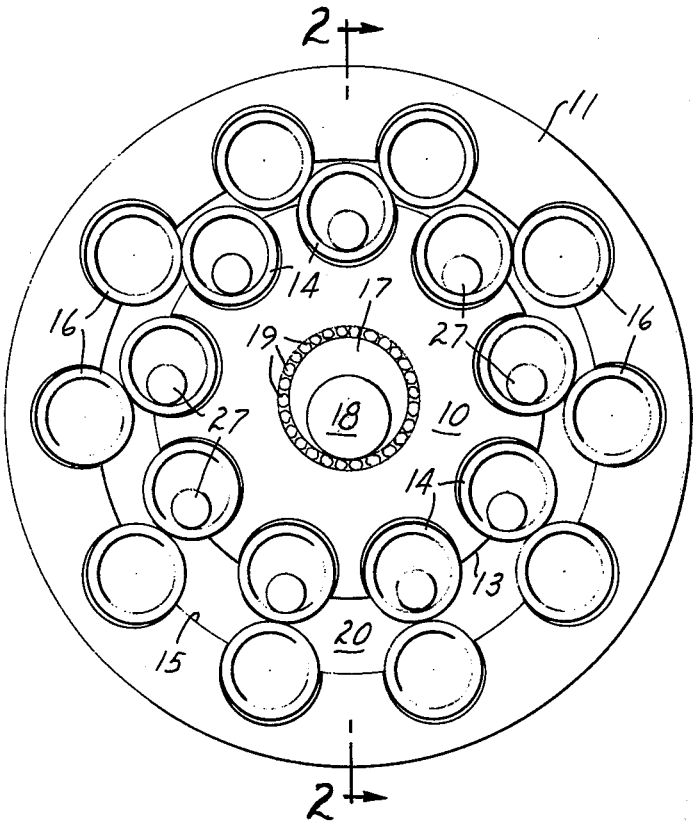
Figure 4:
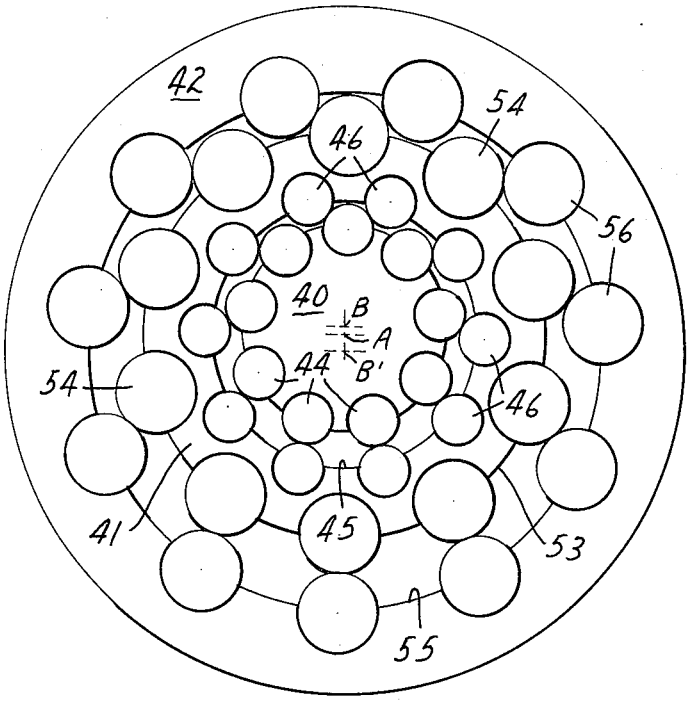
Figure 5:
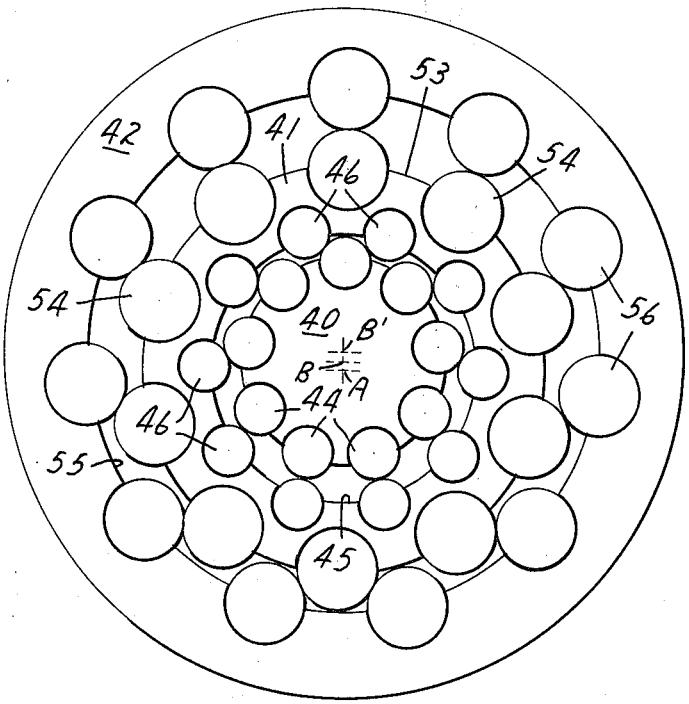
Figure 6:
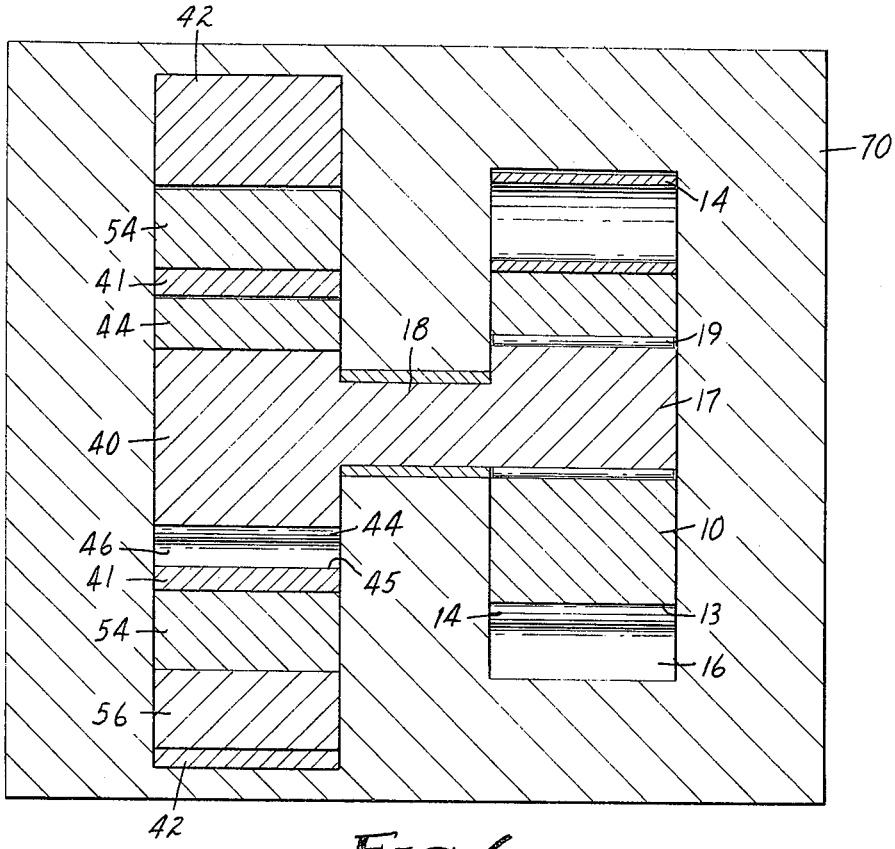
Figure 7:
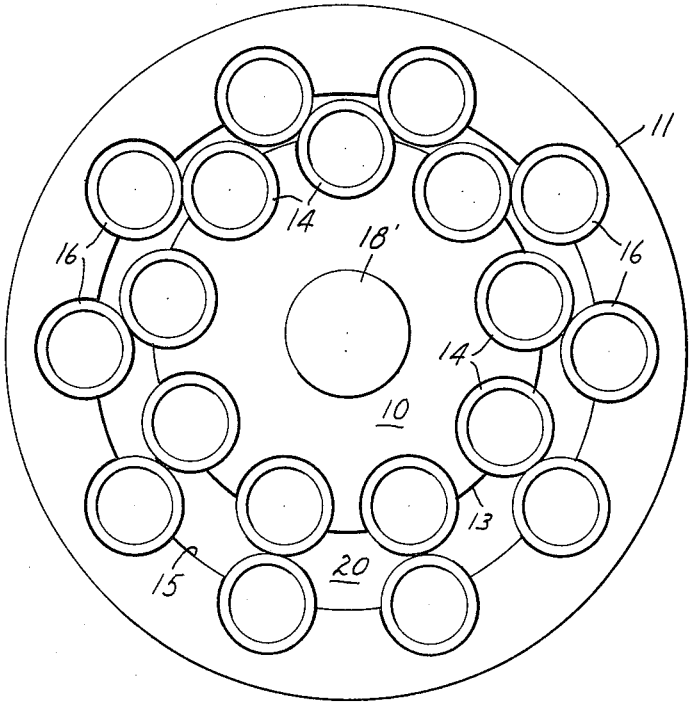

FIG. 4 schematically illustrates a 3-member gear set embodying the invention;

FIG. 5 shows the gear set of FIG. 4 with its gear members positioned on a different set of axes;

FIG. 6 schematically illustrates a pump combining the internal gear sets of FIGS. 1 and 4; and FIG. 7 shows the internal gear set of FIG. 1 fitted with an integral central driveshaft instead of a crankshaft.

The internal gear set shown in FIG. 1 consists of a first or inner gear member 10 and a second or outer gear member 11. The body of the inner gear member 10 has a cylindrical outer face 13 in which are formed nine identical, equally-spaced semi-cylindrical pockets, each containing a hollow roller 14. The body of the outer gear member 11 has a cylindrical inner face 15 in which are formed ten identical, equally-spaced semi-cylindrical pockets, each containing a hollow roller 16. The pockets of each of the gear members 10 and 11 extend arcuately slightly beyond complete semiclyinders to secure the rollers within the pockets which are oversize with respect to the rollers 14 and 16. This permits each roller to move short distances laterally and radially but not out of its pocket. Each of the rollers 14 and 16 is free to move radially except to the extent such movement is restricted by the arcuate extensions of its pocket and by rollers of the other gear member.

Figure 2:
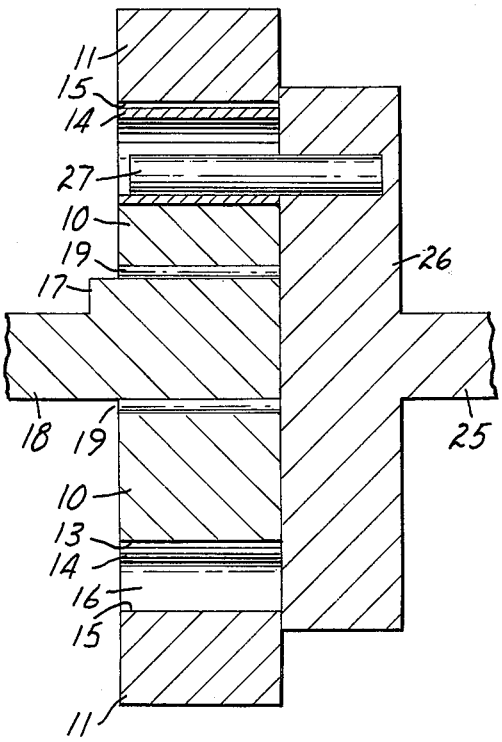
FIG. 2 is a section along line 2—2 of FIG. 1.

The inner gear member 10 is mounted on an eccentric 17 of a crankshaft 18 by a needle bearing 19 such that the axis of the eccentric 17 coincides with the axis of the inner gear member 10 and the axis of the crankshaft 18 coincides with the axis of the second gear member 11. When using the crankshaft 18 as an input shaft, an output shaft 25 on the same axis may be mounted on the opposite side of the internal gear set of FIG. 1 as shown in FIG. 2. Affixed to a plate 26 integral with the output shaft are nine equally spaced cycloid pins 27 centered on a circle having its center at the axis of the shaft 25 and a radius equal to that of a circle through the centers of the inner rollers 14. The inside diameter of the rollers 14 is essentially equal to the diameter of each pin 27 plus twice the eccentricity. The fixed-axis input and output shafts may be contrasted to the wobble shafts required by conventional geroter gear sets.

If one desires to employ solid rollers or rollers that are too small to receive cycloid pins, the inner gear member 10 may be formed with three or more equally spaced holes at a common radius to receive the cycloid pins of a plate similar to the plate 26 of FIG. 2. The diameter of each hole should be approximately equal to or slightly greater than the diameter of each pin plus twice the eccentricity.

The 2-member gear set of FIG. 1 can be used in a fluid pressure device in the same manner as a 2-member geroter gear set. For ech complete revolution of the inner gear member 10 while the outer gear member 11 is stationary, the chamber at 20 collapses and expands nine times. If the inner gear member 10 is stationary, one rotation of the outer gear member 11 collapses and expands the chamber at 20 ten times.

To use the internal gear set of FIG. 1 as the rotary mechanism of a hydraulic motor, one may eliminate the center hole and crankshaft 18 in favor of a cycloid-pin output shaft such as the shaft 25.

When the outer gear member 11 is stationary and the inner gear member 10 is rotated, the axis of the latter traces about the axis of the former a circular orbit, the radius of which equals the eccentricity or one-half the displacement height of one gear member with respect to the other. One revolution of the crankshaft 18 produces 1/9 revolution of the inner gear member 10. In other words, the reduction ratio equals the number of rollers on the first gear member. This gear reduction permits the internal gear set of FIG. 1 to serve as a fluid pump on machines having crankshaft speeds that would burn out the shaft seal of an ordinary pump. For example, the crankshaft speed of a snowmobile may be 9000 rpm, the inner gear member 10 turning at 1000 rpm with the outer gear member 11 stationary.

When the inner gear member 10 is stationary and the outer gear member 11 is rotated, the axis of the latter traces a sinusoidal orbit around the axis of the former. The radius of the pitch circle of the sinusoidal orbit equals the radius of the aformentioned circular orbit. One revolution of the crankshaft 18 produces 1/10 revolution of the outer gear member 11.

By rotating both gear members 10 and 11, their axes may be fixed, spaced equal to one-half of the displacement height of one gear member with respect to the other, as shown in FIG. 7, and a central driveshaft 181 may be integral with the inner gear member. The inner gear member rotates 10 times while the outer gear member rotates nine times.

Before laying out the internal gear set of FIG. 1, one chooses the radius of the circle through the centers of either the rollers 16 or the rollers 14, preferably the former. One then chooses the number and diameters of the rollers 14 and 16 such that there is sufficient space between adjacent rollers to provide structural integrity at the face of the body of each gear member and such that the diameter of the rollers of each gear member exceeds the space between adjacent rollers of the opposing gear member. If the diameter of the rollers of each gear member exceeds 120 percent of the spacing between adjacent rollers of the other gear member, the mechanical action is especially smooth. Preferably the diameter of the rollers 14 equals that of the rollers 16 for economy of manufacture and inventory or, if unequal, the diameter of the outer rollers 16 preferably exceeds, but is not more than about twice the diameter of the inner rollers 14.

Figure 3:
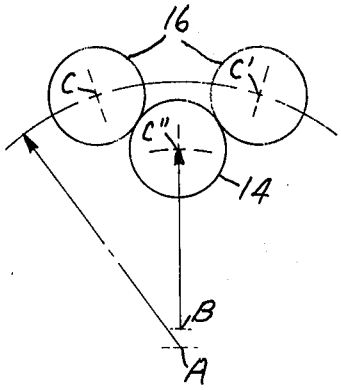
FIG. 3 illustrates the design of the gear set of FIG. 1.

For purposes of illustration, the design of the 2-member gear set of FIG. 1 will now be explained with reference to FIG. 3 wherein A = center of the second or outer gear member 11
B = center of the first or inner gear member 10
C and C′ = centers of two adjacent rollers 16
C″ = center of a roller 14 when tangent to adjacent rollers 16
D = diameter of rollers 16
D″ = diameter of rollers 14

$$AB = \frac{(C''A + \tfrac{1}{2}D'') - (CA - \tfrac{1}{2}D)}{2}$$

AB equals one-half the displacement height of one gear member with respect to the other. If AB is larger or smaller than desired, the diameters and/or spacings between the rollers may be changed. Care must be taken not to make AB so large as to increase the volumetric displacement beyond the structural capabilities of the hydraulic device, with due regard to the maximum rotational speeds that may be achieved.

The body of the inner gear member 10 may be cut from a flat disk, the diameter of which slightly exceeds the breadth of the gear member 10, including its rollers 14. A circle having the center B and the radius BC″ is divided into nine equal segments and a hole is drilled, centered at the end of each segment. The holes are drilled oversize, preferably about 0.1 mm larger in diameter than the rollers they are to receive. The exterior of the disk is then machined to provide the face 13 as shown in FIG. 1. The body of the outer gear member 11 may be similarly constructed from a flat annular blank. The rollers 14 and 16 may be cut from tubing which is then ground and hardened. Preferably the bodies of the gear members 10 and 11 are harder than the rollers 14 and 16, because it is more economical to replace the rollers in the event of undue wear.

The ease of designing and constructing the novel internal gear set stands in marked contrast to difficulties in design and construction of geroter gear sets. If the rollers are worn or damaged in any way, they are easily and economically replaced. Furthermore, the fluid-tight seals between expanding and collapsing chambers insure efficient operation.

An oil pump employing the internal gear set of FIG. 1 has been constructed using cast iron bodies for the gear members and steel tubing for the rollers. An acid pump has been constructed using polyvinyl chloride gear bodies and stainless steel rollers. A hydraulic motor has been constructed with gear bodies of steel hardened to 57 and steel rollers hardened to 35, Rockwell C scale. A fluid pump employing a 2-member internal gear set of the invention having 71 inner rollers and 72 outer rollers generated such high fluid pressures that it ruptured the cast iron body of the outer gear member.

FIG. 4 shows a 3-element internal gear set, the first two members of which are similar to the two gear members of FIG. 1. As in FIG. 1, $n = 9$, the first or inner gear member 40 of FIG. 4 having nine identical rollers 44. The second or intermediate gear member 41 has 10 identical collers 46 at its cylindrical inner face 45 and 10 rollers 54 at its cylindrical outer face 53. Hence, $m = n = 1$. The rollers 46 and the rollers 54 are centered on concentric circles, and each of the outer-facing rollers 54 is centered on the radial line from the center of those concentric circles which bisects the radial angle between the two nearest inner-facing rollers 46.

The third or outer gear member 42 has eleven rollers 56 in its cylindrical inner face 55.

Each of the gear members 40, 41 and 42 is rotatable on a fixed axis. The axis B of the inner gear member 40 and the axis A of the intermediate gear member 41 are the same as shown in FIG. 3 for the gear members 10 and 11 of FIG. 1. The axis B′ of the outer gear member 42 is positioned on extended line AB adjacent axis A such that AB′ = 2AB. By positioning axis B′ adjacent axis A, both the inner and outer expanding chambers are on one side and both the inner and outer collapsing chambers are on the other side of the internal gear set.

For purposes of balance, the axes of the gear members shown in FIG. 4 may be repositioned as shown in FIG. 5. As repositioned, the axis B′ of the outer gear element 42 is located on extended line AB adjacent the axis B such that AB′ = 2AB. Whether positioned as in FIG. 4 or as seen in FIG. 5, the inner gear member 40 rotates 10 $(n + 1)$ times while the intermediate gear member 41 rotated 9 $(n)$ times. The intermediate gear member 41 rotates 11 $(n + 1)$ times while the outer gear member 42 rotates 10 $(m)$ times.

In a hydraulic motor, the inner gear member 40 may have as its output shaft the crankshaft 18 of the internal gear set of FIG. 2. This effectively increases the volumetric displacement of the internal gear set of FIGS. 4 and 5 by the ratio of the rear reduction of FIG. 2. As schematically illustrated in FIG. 6, the internal gear set of FIG. 1 may be used to pump acid with its crankshaft 18 attached to or integral with the inner gear member 40 of the internal gear set of FIG. 4 which is driven by water. Both gear sets may be contained in a case 70 having no protruding driveshaft so that any leakage of acid from the acid pump would be picked up by the water of the motor and carried off. In anticipation of some leakage of acid into the water, the water may initially be slightly alkaline.

In a 3-member gear set where AB′ equals 3AB or 4AB, the volumetric displacement at the outer chambers becomes exceedingly large compared to that at the inner chambers. This has utility for automatically mixing high ratios of two fluids such as a thermosetting resin with a small proportion of a curing agent.

What is claimed is:

1. An internal gear set comprising first and second gear members, the first gear member having $n$ identical cylindrical rollers in slightly oversize semi-cylindrical pockets formed in its radially outer face and equally spaced along a circle, the center of which is the axis of the first gear member, and the second gear member having $n + 1$ identical cylindrical rollers in slightly oversize semi-cylindrical pockets formed in its radially inner face and equally spaced along a circle having the axis of the second gear member as its center, $n$ being an integer greater than 2, the first gear member nesting within and axially offset from the second gear member to provide expanding and collapsing chambers between the gear members upon rotation of one gear member relative to the other, each roller being free to move radially except to the extent that such movement may be restricted by its pocket and by rollers of the other gear member, and the diameter of each roller exceeding the spacing between adjacent rollers of the other gear member.

2. An internal gear set as defined in claim 1 wherein $n$ is at least 5.

3. An internal gear set as defined in claim 1 wherein the rollers of the first gear member are identical to those of the second.

4. An internal gear set as defined in claim 1 wherein the first gear member has a central opening for journalling the eccentric of a crankshaft.

5. An internal gear set as defined in claim 1 wherein the first gear member has an integral central driveshaft.

6. A hydraulic device incorporating an internal gear set as defined in claim 1 wherein one of said gear members is stationary and the axis of the other orbits about the axis of the stationary member.

7. An internal gear set as defined in claim 1 wherein the pockets extend arcuately beyond semi-cylinders to hold the rollers in place during assembly.

8. An internal gear set as defined in claim 1 wherein the diameter of the rollers of each gear member exceeds 120 percent of the spacing between adjacent rollers of the other gear member.

9. A fluid displacement device incorporating an internal gear set as defined in claim 1 wherein the first gear member is formed with three or more equally spaced holes of equal diameter, each centered on a circle, the center of which is the axis of the first gear member, which fluid displacement device includes a drive shaft concentric with the second gear member and an integral plate having a cycloid pin for each said hole, said pins being centered on a circle having its center at the axis of the driveshaft and a radius equal to that of the first-mentioned circle, the diameter of said holes approximately equalling or exceeding the diameter of each pin plus twice the eccentricity of the gear set.

10. A fluid displacement device as defined in claim 9 wherein said holes are centered in the rollers of the first gear member.

11. An internal gear set as defined in claim 1, the second gear member having $m$ identical rollers in slightly oversize pockets formed in its radially outer face and equally spaced along a circle having the axis of the second gear member as its center, which gear set further includes a third gear member having $m + 1$ identical rollers in slightly oversize pockets formed in its radially inner face and equally spaced along a circle having the axis of the third member as its center, $m$ being an integer greater than 2, the second gear member nesting within and axially offset from the third gear member to provide upon relative rotation an outer set of expanding and collapsing chambers, each gear member being rotatable on a unique fixed axis, the three axes lying on a straight line, the distance between the axes of the second and third gear members being an integral multiple of the distance between the axes of the first and second gear members.

12. An internal gear set as defined in claim 11 wherein the integral multiple is 2, 3 or 4.

13. A hydraulic device incorporting an internal gear set as defined in claim 11 wherein both the expanding outer chambers and the expanding first-mentioned chambers are on the same side of the internal gear set.

14. A hydraulic device incorporating an internal gear set as defined in claim 11 wherein the outer chambers expand 180° out of phase with the expansion of the first-mentioned chambers.

15. An internal gear set as defined in claim 11 wherein $m$ equals $n + 1$.

16. An internal gear set as defined in claim 15 wherein each outer-facing pocket of the second gear member is midway between its adjacent inner-facing pockets.

* * * * *